US006405098B1

(12) United States Patent
Mehlis et al.

(10) Patent No.: US 6,405,098 B1
(45) Date of Patent: Jun. 11, 2002

(54) CONTROL ARRANGEMENT FOR UNWINDING EQUIPMENT FOR WEBS

(75) Inventors: Bernd Mehlis; Josef Hammer, both of Plauen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/574,272

(22) Filed: May 19, 2000

(30) Foreign Application Priority Data

May 20, 1999 (DE) ..... 199 23 204

(51) Int. Cl.[7] ..... B65H 23/08
(52) U.S. Cl. ..... 700/139; 242/421; 101/225
(58) Field of Search ..... 700/139, 130; 242/421, 421.5, 421.6, 421.7, 413.5; 226/44, 45; 101/219, 225

(56) References Cited

U.S. PATENT DOCUMENTS 5,277,373 A * 1/1994 Morton ..... 226/44 X
6,168,108 B1 * 1/2001 Morley ..... 242/421.1

FOREIGN PATENT DOCUMENTS

| | | |
|---|---|---|
| DE | 41 28 860 | 3/1993 |
| DE | 195 20 955 | 12/1996 |
| EP | 0 556 132 | 2/1993 |
| GB | 2 240 409 | 7/1991 |

* cited by examiner

*Primary Examiner*—Peter Nerbun
(74) *Attorney, Agent, or Firm*—Cohen, Pontani, Lieberman & Pavane

(57) ABSTRACT

A control arrangement for controlling web unwinding equipment used for feeding webs to a web-fed rotary printing machine stabilizes a swing roll used to tension the web at a central position via an integrator in a manner independent of the coefficient of friction. A proportional and differential element is connected in parallel with the integrator. The inputs of the integrator and the proportional and differential element are connected directly or indirectly to a swing-roll transmitter whose output is dependent on a position of the swing roll. The outputs of the integrator and the proportional and differential element act on an adder element. The output of the adder element acts directly or indirectly on a brake for braking the rotation of the wound roll.

10 Claims, 2 Drawing Sheets

CONTROL ARRANGEMENT FOR UNWINDING EQUIPMENT FOR WEBS

BACKGROUND OF THE INVENTION

1. Field of the Invention

The present invention relates to a control arrangement for controlling web unwinding equipment for unwinding a roll containing a web to be used in a web-fed rotary printing machine.

2. Description of the Related Art

A control arrangement for controlling web unwinding equipment is disclosed in German reference DE 41 28 860 A1 including an integrator which sets the gain of a control loop and controls the central position of a dancer roll. A problem with this device is that a high gain is required to control the central position of the dancer roll. Furthermore, this device provides control only by introducing a negative torque via a brake.

Another control arrangement for controlling web unwinding equipment is disclosed in German reference DE 195 20 955 A1 in which a four-quadrant drive is used. This type of drive is very complicated and expensive. A further problem is that the control arrangement is pure rotational speed control, which always has to calculate its rotational speed signal from the roll diameter or a parameter related to the roll diameter.

SUMMARY OF THE INVENTION

It is an object of the present invention to provide a control arrangement for controlling web unwinding equipment used for unwinding webs from a wound roll for feeding the web to a web-fed rotary printing machine without a diameter signal from the wound roll using the interplay between drive and brake to control the unwinding.

According to the invention, the object is achieved by a control arrangement for controlling web unwinding equipment used for unwinding a web from a wound roll for feeding a web-fed rotary printing machine, the web unwinding equipment including a swing roller arranged in a loop of the web for keeping a constant tension on the web, wherein the swing roller is movable to maintain the constant tension, the control arrangement comprising, a transmitter having a transmitter output and operatively connectable for monitoring a position of the swing roller, the output being dependent on the position of the swing roller, an integrator having an input connected to the transmitter output and having an integrator output, a proportional and differential element having an input connected to the transmitter output and having a proportional and differential output, an adder having inputs connected to the integrator output and the proportional and differential output and having an adder output, and a braking element operatively connectable to the wound roll for generating a braking force for braking the wound roll, wherein a value of the braking force is responsive to the adder output.

A control arrangement for controlling web unwinding equipment used for unwinding a web from a wound roll for feeding a web-fed rotary printing machine, comprising, a swing roller operatively arranged in a loop of the web for keeping a constant tension on the web, wherein the swing roller is movable from a central position to maintain the constant tension, a transmitter having a transmitter output and operatively connectable for monitoring a position of the swing roller, the output being dependent on the position of the swing roller, a two-quadrant drive operatively connectable to the wound roll for applying a torque to a core of the wound roll, thereby exerting an influence on the rotational speed of the wound roll, a motor controller for controlling the two-quadrant drive, the motor controller being connected to a synchronous rotation speed input signal comprising a rotational speed of the web divided by the diameter of a replacement wound roll, an integrator having an input connected to the transmitter output and having an integrator output, a first polarity-dependent element having an input arranged for receiving the transmitter output and having a first polarity-dependent output, a proportional and differential element having an input connected to the first polarity-dependent output and having a proportional and differentiated output, a second polarity-dependent element having an input arranged for receiving the transmitter output and having a second polarity-dependent output connected to the motor controller, an adder having inputs connected to the integrator output and the proportional and differentiate output and having an adder output, a braking element operatively connectable to the wound roll for generating a braking force for braking the rotation of the wound roll, and an electro-pneumatic converter having an input connected to the adder output and an electro-pneumatic converter output connected to the braking element, wherein a value of said braking force is responsive to said electro-pneumatic converter output.

The control arrangement according to the present invention permits the operation of a four-quadrant control system without requiring the calculation of a diameter signal. When the machine is being started up with a wound reel of unknown diameter, a deviation of the swing-roll system from the central position occurs which is only brief, low and therefore unimportant for the web tension. After the initial deviation, no residual error occurs and the swing-roll system is controlled to the central position.

The four-quadrant control system is formed from a two-quadrant drive and a brake, wherein the positive torques, i.e., the drive and acceleration of the wound reel, are controlled by the two-quadrant drive and the negative torques, i.e., the braking of the wound reel, is performed and controlled by the brake.

A significant advantage of the present invention applies in particular to the torque control system of the control arrangement in that the present invention permits the implementation of a braked roll changer with an auxiliary drive.

A further advantage of the present invention is that the web unwinding equipment may also be controlled solely via the brake in the event of a failure or malfunction of the two-quadrant drive. In this emergency-mode of the control arrangement, the web tension is controlled only with the aid of the brake.

It is also an advantage of the present invention that a positive torque is applied to the wound roll by the drive. In the event of positive acceleration values of the web or severe fluctuations in speed which may occur, for example, when threading paper, the wound roll must be accelerated in response to the tension on the web.

In addition, the present invention achieves a high control stability in that pilot brake control is implemented via the integrator in a manner independent of the coefficient of friction and acts as a damping system. As a result, the control loop gain may be kept relatively low.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
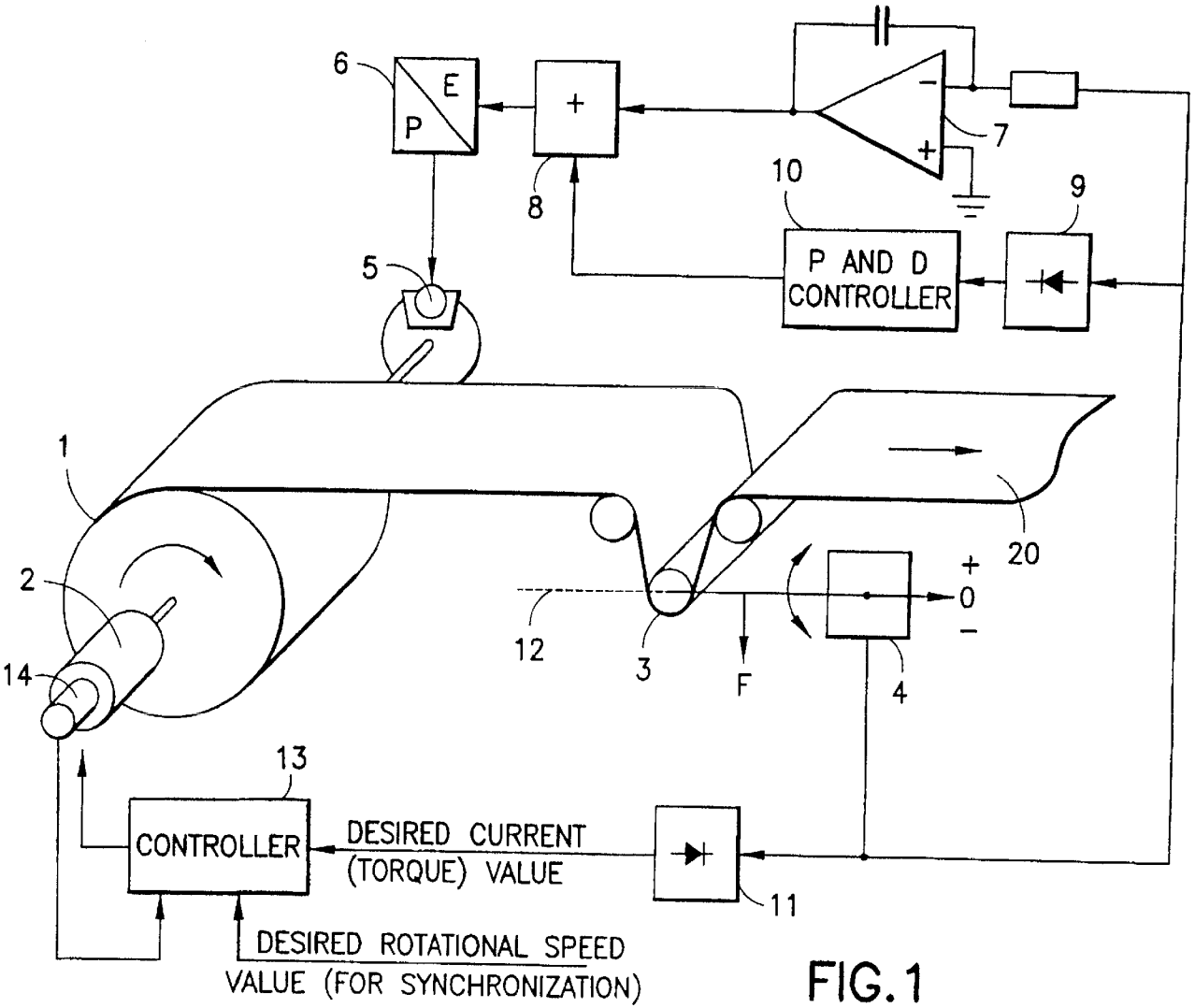
FIG. 1 is a schematic diagram showing the control arrangement according to an embodiment of the present invention.

Referring to FIG. 1, a wound roll 1 comprises a core 1*a* on which a web 20 is wound. The web 20 is fed via a swing roll system 3 to a web-fed device such as a web-fed rotary printing machine (not shown). The core 1*a* of the wound roll 1 is connected to a motor 2 which is used to rotate the wound roll 1. The current rotational speed value is fed back to a motor controller 13 by a tachometer 14 or other sensor device which measures the speed of rotation.

A disc brake 5 activated pneumatically via an electro-pneumatic converter 6 acts on the other side of the core 1*a* of the wound roll 1.

The swing roll 3 produces a specific web tension by being pressed into a web loop with a defined force F—the force F may be applied by a pneumatic rolling diaphragm cylinder (not specifically described) which is in turn activated via an electro-pneumatic converter. The web tension may be varied by varying the defined force F, for example, by varying an analogue voltage at the input of the electro-pneumatic converter. The angular position of the swing roll 3 is registered by a transmitter 4 which operates without contact. The transmitter supplies an analogue output signal, for example, from +10 V to −10 V DC in response to the angular position of the swing roll 3.

The task of the motor controller 13 at the wound roll core 1*a* is always to keep the swing roll 3 as far as possible in a central position 12. Dynamic disturbances may deflect the swing roll 3 without producing great changes in the web tension. However, the swing roll should be designed so that the end positions of its operating range are not reached during operation.

To achieve a tension in the paper web 20, the wound reel 1 must be continuously braked. Speed changes on the web 20 or printing machine in this case act as dynamic disturbing variables.

The most extreme disturbances occur in the event of a safety stop of the machine. In this circumstance, retardations up to about 1.5 $m/s^2$ are possible. Since, in the event of positive acceleration values of the web 20 or severe fluctuations in speed which may occur when threading a web comprising paper, the wound roll 1 must be accelerated by the tension on the web 20, it is advantageous to apply a positive torque to the roll core 1*a* via the motor 2 as well. In this way, it is also possible to overcome the residual friction which occurs as disturbing additional braking effect at small roll radii and high rotational speed.

When an old wound core is running out of web 20, a new wound roll 1 may be spliced on the fly to the web that is currently being fed to the machine. In this case, when preparing for the flying splice, the motor connected to the new wound roll is required to accelerate the new wound roll to a circumferential speed which corresponds exactly to the web speed of the current wound roll, i.e., the old roll, which is running out of web. In addition, after the old web has been cut off of the old roll, the paper tail which has already been unwound is wound back onto the old wound roll by the motor connected to the old wound roll.

Given a constant web speed, a specific brake pressure is required to bring the swing roll 3 into its central position 12. This brake pressure depends on the amount of web tension to be applied, the diameter of the wound roll 1 (which is constantly diminishing) and on the gain or the coefficient of friction of the brake, although this is not constant. The gain or coefficient of friction of the brake can change considerably as a function of temperature, surface pressure and frictional speed. For this reason, prior calculation of the necessary brake pressure from the abovementioned parameters is not possible.

An integrator 7 connected to the angle transmitter 4 of the swing roll 3 has an output connected to an electro-pneumatic converter 6 and therefore the brake 5 via an adder element 8. Accordingly, the integrator 7 sets the brake pressure precisely and independently of measurement of the coefficient of friction and diameter of the wound roll 1, to a value which leads the swing roll 3 into the central position 12 corresponding to 0 V at the output of the angle transmitter 4. However, the integration time must be set significantly slower than the reaction time of the swing-roll movement and braking action, otherwise the control arrangement would not operate in a stable fashion and would begin to oscillate. Dynamic disturbances are controlled as follows: Positive swing-roll angle signals output from the angle transmitter 4 (indicating a requirement to brake harder) pass via the polarity-dependent element 9 to a proportional and differential element 10 whose parameters may be preset and are connected as a further input to the adder element 8. It is therefore possible for additional pressure to be applied to the brake 5 until the integrator 7 has readjusted or the disturbance has ended. Negative swing-roll angle signals output from the angle transmitter 4 pass via the polarity-dependent element 11 to the desired current value input of the motor controller 13. As a result of the positive torque produced on the wound roll 1, the swing roll 3 has an influence exerted on it until the integrator 7 has readjusted downwards or the disturbance has ended.

The integrator 7 implements an adaptive pilot brake control system which automatically adapts to web tension, diameter and brake gain. If the swing roll 3 is at rest in the central position 12, only the integrator 7 acts to form the braking torque.

In the event of speed changes in the machine being fed, the swing roll 3 will be deflected out of the central position 12 because of the inertia of the wound roll 1. In this case, the integrator value must be frozen until the swing roll has reached steady state based on the new speed so that it does not integrate to an excessively high or excessively low value. Dynamic disturbances have the effect of changing the position of the swing-roll 3. In this case, both additional braking torque and also driving torque may be applied, depending on the direction of the deflection.

Figure 2:
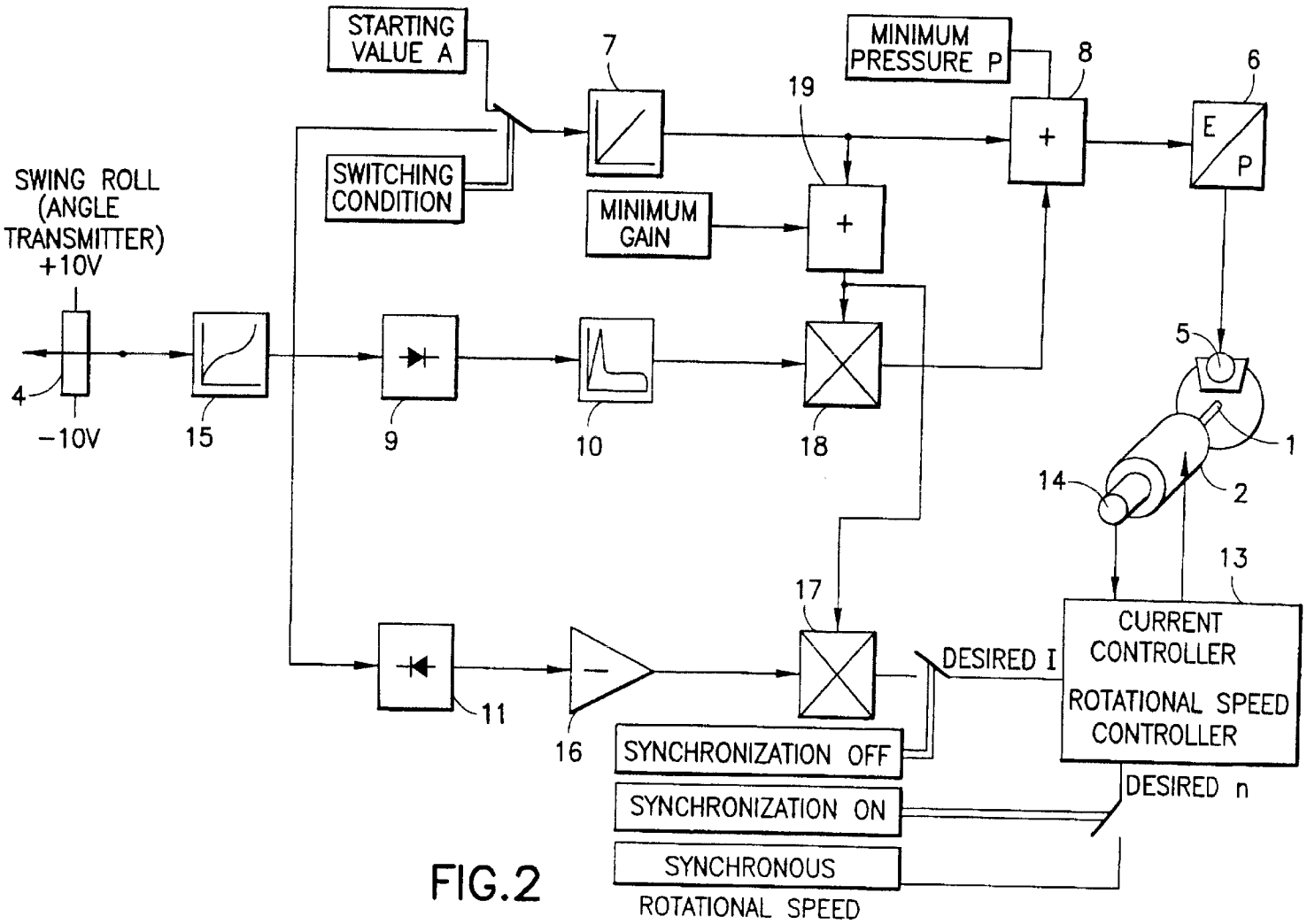
FIG. 2 is a schematic diagram showing a further embodiment of the control arrangement according to the present invention.

A refined embodiment of the above-described control arrangement is shown in FIG. 2. In this embodiment, a characteristic-curve generator 15, which changes the influence of the swing roll 3 (not shown in FIG. 2) as a function of the position of the latter by a modeled S characteristic curve, has been placed in the signal path of the swing-roll angle transmitter 4.

For deflections around the central position 12, the influence per amount of deflection is lower and rises more and more towards the end positions. This is intended to prevent the swing roll 3 striking the end positions in the event of large disturbances.

A starting-value input signal is connected to the integrator 7 and is used to preset the starting value of the integrator when a new wound roll is started. This presetting is necessary when starting up with a new wound roll 1 and the starting value (A) is set as a function of the web tension to be applied in such a way that at maximum possible diameter the swing roll 3 is just still pulled into its central position 12.

Following a splice of the start of a new large wound roll 1 to a smaller used up roll, the integrator 7 must likewise be given a starting value (A), which is calculated from the (known) diameter and the instantaneous web tension (width×web tension). In the event of a safety stop, a value which is calculated from the starting value of the integrator 7 before the stop and the current reel diameter is likewise connected up. As shown in the Figures, the wound roll 1 is center-controlled, i.e., the motor 2 and brake 5 act on the core 1*a* of the wound roll 1, and the radius of the wound roll acts as a lever arm. Accordingly, as the diameter of the wound roll diminishes, the influence of the swing roll 3 must also correspondingly decrease become lower.

For this reason, the signals for additional braking action and additional driving action each use a multiplier element 17, 18, which reduces the gain by reducing the signal at its second input. This signal may advantageously be obtained from the output signal from the integrator 7, since this likewise decreases with the diameter.

An additional input connected to the adder element 8 before the electro-pneumatic converter 6 also permits a minimum brake pressure (p) to be set. This is necessary to overcome the spring action of the brake-shoe return and to avoid an on/off effect at very low pressures. An inverter 16 inverts the sign in the motor signal, since the motor 2 must likewise produce a positive torque. To synchronize a new fully loaded wound roll 1, that is to say the new roll, and/or to rewind a residual roll after it has been disconnected, the motor 2 must be operated under rotational speed control. For this reason, the desired torque value I input signal is switched off and a desired rotational speed value n input signal is connected up in these situations. The rotational speed for the synchronization is calculated from the reciprocal of the diameter and the machine speed. In this case, the diameter of the loaded roll 1 may be calculated from the angular position of a carrying arm, which is determined when rotation is stopped in the splicing position.

The entire control structure is a constituent part of the control program in the roll changer. The representation as an analogue signal control system serves merely for better understanding. The analogue circuit technology described may be implemented wholly or partly in a computer.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A control arrangement for controlling web unwinding equipment used for unwinding a web from a wound roll for feeding a web-fed rotary printing machine, said web unwinding equipment including a swing roller arranged in a loop of the web for keeping a constant tension on the web, wherein the swing roller is movable to maintain the constant tension, said control arrangement comprising:

a transmitter having a transmitter output and operatively connectable for monitoring a position of the swing roller, said output being dependent on the position of the swing roller;

an integrator having an input connected to said transmitter output and having an integrator output;

a proportional and differential element having an input connected to said transmitter output and having a proportional and differential output;

a first adder having inputs connected to said integrator output and said proportional+differential output and having a first adder output; and a braking element operatively connectable to the wound roll for generating a braking force for braking said wound roll, wherein a value of said braking force is responsive to said adder output.

2. The control arrangement of claim 1, further comprising a characteristic-curve generator having an input connected to the transmitter output and having a characteristic-curve output connected to said integrator input and said proportional and differential element input, such that said integrator and said proportional and differential element are connected to said transmission output via said characteristic curve generator.

3. The control arrangement of claim 1, wherein said integrator is connected to a starting value input signal and wherein said first adder element is connected to a minimum pressure value (p) input signal.

4. The control arrangement of claim 1, further comprising:

a multiplier element having an input connected to said proportional and differential element output and having a multiplier output connected as an input to said first adder element; and a second adder element having inputs connected to said integrator output and to a minimum gain (v) input signal and an output connected to said multiplier element.

5. A control arrangement for controlling web unwinding equipment used for unwinding a web from a wound roll for feeding a web-fed rotary printing machine, comprising:

a swing roller operatively arranged in a loop of the web for keeping a constant tension on the web, wherein the swing roller is movable from a central position to maintain the constant tension;

a transmitter having a transmitter output and operatively connectable for monitoring a position of said swing roller, said output being dependent on the position of said swing roller;

a two-quadrant drive operatively connectable to the wound roll for applying a torque to a core of the wound roll, thereby exerting an influence on the rotational speed of the wound roll;

a motor controller for controlling said two-quadrant drive, said motor controller being connected to a synchronous rotation speed input signal comprising a rotational speed of the web divided by the diameter of a replacement wound roll;

an integrator having an input connected to said transmitter output and having an integrator output;

a first polarity-dependent element having an input arranged for receiving said transmitter output and having a first polarity-dependent output;

a proportional and differential element having an input connected to said first polarity-dependent output and having a proportional and differential output;

a second polarity-dependent element having an input arranged for receiving said transmitter output and having a second polarity-dependent output connected to said motor controller;

a first adder having inputs connected to said integrator output and said proportional and differential output and having a first adder output;

a braking element operatively connectable to the wound roll for generating a braking force for braking the rotation of the round wound roll; and an electro-pneumatic converter having an input connected to said adder output and an electro-pneumatic converter output connected to said braking element, wherein a value of said braking force is responsive to said electro-pneumatic converter output.

6. The control arrangement of claim 5, further comprising a characteristic-curve generator having an input connected to the transmitter output and having a characteristic-curve output connected to said integrator input, said first polarity-dependent element input, and said second polarity-dependent element input such that each of said integrator, said first polarity-dependent element, and said second polarity-dependent element are connected to said transmission output via said characteristic curve generator.

7. The control arrangement of claim 5, wherein said integrator further comprises a connection to a starting value input signal and wherein said first adder element further comprises a connection to a minimum pressure value (p) input signal.

8. The control arrangement of claim 5, further comprising:

a first multiplier element having an input connected to said proportional and differential element output and having a first multiplier output connected as an input to said first adder element; and a second adder element having inputs connected to said integrator output and a minimum gain (v) input signal and an output connected to said multiplier element.

9. The control arrangement of claim 8, further comprising:

an inverter connected between said second polarity-dependent element and said motor controller; and a second multiplier element having inputs connected to the inverter output and said second adder element output and having a second multiplier element output connected to said motor controller.

10. The control arrangement of claim 5, wherein at least a portion of said control arrangement is implemented via a computer.

* * * * *